US007660554B2

(12) United States Patent
Takagi et al.

(10) Patent No.: US 7,660,554 B2
(45) **Date of Patent: *Feb. 9, 2010**

(54) HEAT FIXING DEVICE

(75) Inventors: Osamu Takagi, Chofu (JP); Satoshi Kinouchi, Shinjuku-ku (JP); Yoshinori Tsueda, Fuji (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 118 days.

This patent is subject to a terminal disclaimer.

(21) Appl. No.: 11/736,087

(22) Filed: Apr. 17, 2007

(65) Prior Publication Data

US 2008/0260437 A1 Oct. 23, 2008

(51) Int. Cl.
*G03G 15/20* (2006.01)

(52) U.S. Cl. ..... 399/329; 399/330

(58) Field of Classification Search ..... 399/67, 399/68, 328, 329, 330; 219/216
See application file for complete search history.

(56) References Cited

U.S. PATENT DOCUMENTS 5,689,788 A * 11/1997 Moser ..... 399/328
6,263,172 B1 * 7/2001 Suzuki et al. ..... 399/67
2003/0152405 A1 * 8/2003 Takeuchi et al. ..... 399/328
2004/0265018 A1 * 12/2004 Takahashi ..... 399/328
2005/0025511 A1 * 2/2005 Watabe ..... 399/67
2006/0067753 A1 * 3/2006 Katayanagi ..... 399/329
2006/0099015 A1 * 5/2006 Miyazaki ..... 399/328
2006/0216078 A1 * 9/2006 Higashi et al. ..... 399/333
2008/0124109 A1 * 5/2008 Sone et al. ..... 399/67

FOREIGN PATENT DOCUMENTS

JP 2001-006868 1/2001
JP 2005-158639 6/2005
JP 2006313256 A * 11/2006

* cited by examiner

*Primary Examiner*—David M Gray
*Assistant Examiner*—Gregory H Curran
(74) *Attorney, Agent, or Firm*—Turocy & Watson, LLP

(57) ABSTRACT

In an induction heat fixing device of the invention, a metal conductive layer of a heat roller is supported by a foamed rubber (sponge). A sheet paper is curled in a direction of separating from the heat roller by a nip shape between the heat roller and a press roller. The press roller is formed to be longer than the heat roller to such a degree that even if the heat roller laterally shifts, an edge of the press roller does not come in contact with the heat roller.

8 Claims, 4 Drawing Sheets

HEAT FIXING DEVICE

BACKGROUND OF THE INVENTION

1. Field of the Invention

The present invention relates to a heat fixing device which is mounted in an image forming apparatus, such as a copier, a printer or a facsimile, includes a heating target member which is heated by induction heating, and fixes a toner image on a sheet by the heating target member.

2. Description of the Related Art

As a fixing device used for an image forming apparatus such as a electro photographic copier or printer, there is a device in which a sheet is inserted into a nip formed between a pair of rollers including a heat roller and a pressure roller or between a pair of a heat belt and a pressure roller, and a toner image is heated, pressed and fixed. In such a heating type fixing device, in order to realize speeding up of process speed, there is an induction heat fixing device in which a heat roller or a heating belt is heated by an induction heating system. In the induction heat fixing device, an eddy-current is generated in a metal conductive layer by a magnetic field which is generated by supplying specified power to an induction current generation coil. The metal conductive layer is instantaneously heated by this eddy-current, and for example, the heat roller is heated.

As one of such induction heat fixing devices, there is a device in which a very thin metal conductive layer is disposed near the surface of a heat roller or a heat belt, and an induction current generation coil is disposed outside the heat roller or the heat belt so as to be opposite thereto. In the device as stated above, since the heat capacity of the metal conductive layer is small and the metal conductive layer is disposed near the surface, the speed of heating of the surface of the heat roller or the heat belt can be further increased. On the other hand, since the metal conductive layer near the surface is very thin, there is a fear that it is damaged by the contact of a peel pawl or the like.

Thus, there is developed a device in which after fixing, a sheet paper is peeled off from a heat roller without using a peel pawl. For example, the metal conductive layer of the surface of the heat roller is supported by an elastic layer, so that the surface of the heat roller has elasticity, and the hardness of the surface of the press roller is made higher than the heat roller. By this, the curve of a section of a nip between the heat roller and the press roller is formed into such a curve that a sheet paper is predisposed to peel off from the heat roller. That is, although the peel pawl is not used, the surface of the heat roller is made to have elasticity, so that the sheet paper is peeled off from the heat roller by using the toughness of the sheet paper and the curl direction of the sheet paper.

However, in the heat roller or the heat belt which includes the metal conductive layer supported by the elastic layer and has elasticity in the surface, the right and left balance becomes unstable at the time of rotation. Thus, the heat roller or the heat belt is liable to laterally shift at the time of rotation.

For example, as shown in the Prior Art of FIG. 1, when a heat roller 100 laterally shifts and comes in contact with an edge 102*a* of a press roller 102, there is a fear that a crack 100*b* occurs in a thin metal conductive roller near the surface of the heat roller 100. Alternatively, when the heat roller 100 laterally shifts, a stress occurs in an elastic layer intervening between the metal conductive layer and a cored bar, and when it is a sponge or the like, there is a fear that a contact portion with the cored bar is broken.

Thus, for example, JP-A-2005-158639 or JP-A-2001-6868 discloses a flange to regulate the shift of a fixing film having a metal layer at the time of running.

However, in these devices of the relater art, although the shift of the fixing film is regulated, interference of the edge of the pressure roller is received due to its structure. Thus, there is a fear that by long-term use, a crack occurs in the metal layer by the contact with the edge of the press roller, and prolongation of the life of the heat roller is prevented.

Then, in a heat fixing device including a heating target member which includes a metal conductive layer supported by an elastic layer, and a pressure member, there is desired the heat fixing device which prevents a crack of the metal conductive layer of the heating target member, and prevents destruction of the elastic layer, so that the life of the heating target member is prolonged.

SUMMARY OF THE INVENTION

In an aspect of the invention, at the time of rotation of a heating target member, it is prevented that an edge of a pressure member comes in contact with the heating target member, and it is prevented that a crack occurs in a metal conductive layer, or at the time of rotation of the heating target member, it is prevented that an elastic layer receives a stress, and the destruction of the elastic layer is prevented. As a result, there is provided a heat fixing device in which the life of the heating target member is prolonged.

According to an embodiment of the invention, a heat fixing device includes a heating target member that is endless, has a metal conductive layer supported by an elastic member and has a first length in an axial direction, a pressure member that has a second length extending to outsides of both sides of the heating target member in the axial direction, comes in press contact with the heating target member at a side opposite to the elastic member, and, together with the heating target member, nips and carries a fixing target medium in a specified direction, and an induction current generation member that is disposed at a periphery of the heating target member and heats the metal conductive layer.

DETAILED DESCRIPTION OF THE PREFERRED EMBODIMENT

Figure 1:
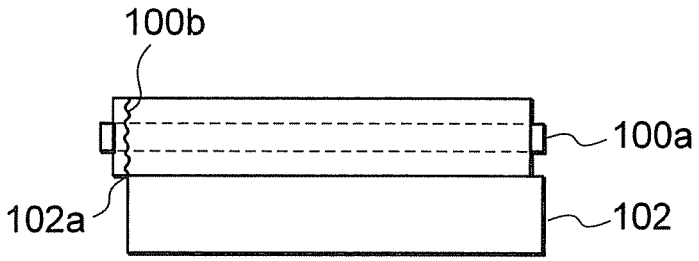
FIG. 1 Prior Art
FIG. 1 is a schematic explanatory view showing deterioration of a heat roller of the Prior Art of the invention.
Figure 2:
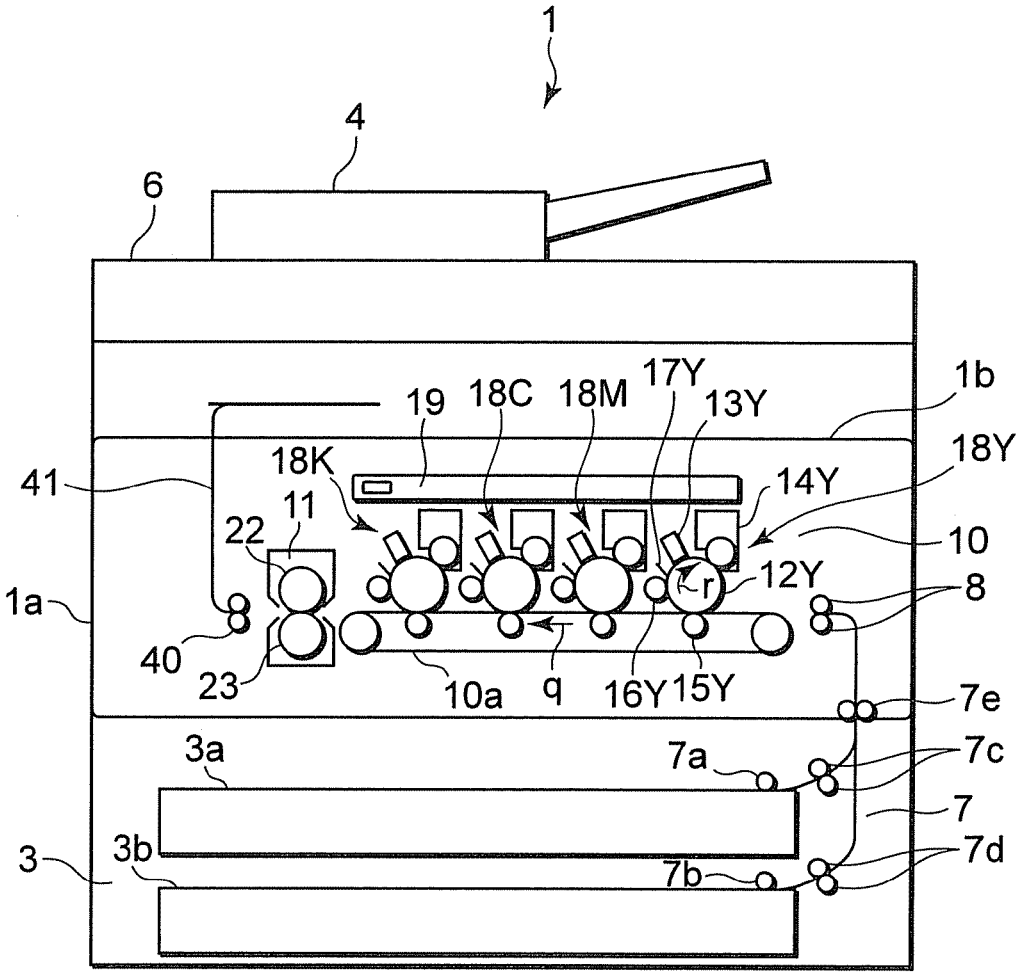
FIG. 2 is a schematic structural view showing an image forming apparatus in which a fixing device of a first embodiment is mounted.

Hereinafter, a first embodiment of the invention will be described in detail with reference to the accompanying drawings. FIG. 2 is a schematic structural view showing an image forming apparatus 1 in which a fixing device 11, which is a heat fixing device of the first embodiment of the invention, is mounted. A scanner unit 6 to read an original document supplied by an automatic document feeder 4 is provided at an upper surface of the image forming apparatus 1. The image forming apparatus 1 includes a cassette mechanism 3 to supply a sheet paper P, which is a fixing target medium, to an image forming unit 10.

The cassette mechanism 3 includes a first and a second paper feed cassettes 3*a* and 3*b*. Pickup rollers 7*a* and 7*b* to take out a sheet paper from the paper feed cassettes 3*a* and 3*b*, separation conveyance rollers 7*c* and 7*d*, a conveyance roller 7*e* and a register roller 8 are provided along a conveyance path 7 from the respective paper feed cassettes 3*a* and 3*b* to the image forming unit 10. The fixing device 11, which is the heat fixing device, to fix a toner image formed on the sheet paper P in the image forming unit 10 is provided on the downstream side of the image forming unit 10. A paper eject roller 40 is provided on the downstream side of the fixing device 11, and a paper eject conveyance path 41 to convey the sheet paper P after fixing to a paper eject portion 1*b* is provided.

The image forming unit 10 includes image forming stations 18Y, 18M, 18C and 18K of respective colors of yellow (Y), magenta (M), cyan (C) and black (K). The respective image forming stations 18Y, 18M, 18C and 18K are arranged in tandem along a transfer belt 10*a* rotated in an arrow q direction.

The yellow (Y) image forming station 18Y is formed such that a charger 13Y as a process member, a developing device 14Y, a transfer roller 15Y, a cleaner 16Y and a charge-removal unit 17Y are disposed around a photoconductive drum 12Y which is an image carrier rotating in an arrow r direction. A laser exposure device 19 to irradiate a laser beam to the photoconductive drum 12Y is provided above the image forming station 18Y of yellow (Y).

The image forming stations 18M, 18C and 18K of the respective colors of magenta (M), cyan (C) and black (K) have the same structure as the image forming station 18Y.

When the print operation is started, in the image forming station 18Y of yellow (Y), the photoconductive drum 12Y is rotated in the arrow r direction and is uniformly charged by the charger 13Y. Next, by the laser exposure device 19, the photoconductive drum 12Y is irradiated with an exposure light corresponding to image information read by the scanner unit 6 and an electrostatic latent image is formed. Thereafter, a toner image is formed on the photoconductive drum 12Y by the developing device 14Y. At the position of the transfer roller 15Y, the toner image on the photoconductive drum 12Y is transferred to the sheet paper P conveyed on the transfer belt 10*a* in the arrow q direction. After completion of the transfer of the toner image, the remaining toner on the photoconductive drum 12Y is cleaned by the cleaner 16Y, the remaining charge is removed by the charge-removal unit 17Y, and next printing becomes possible.

In the image forming stations 18M, 18C and 18K of the respective colors of magenta (M), cyan (C) and black (K), an image forming operation is performed similarly to the image forming station 18Y of yellow (Y), and a full-color toner image is formed on the sheet paper P. Thereafter, the sheet paper P is heated, pressed and fixed by the fixing device 11, so that the print image is completed, and the sheet paper is ejected to the paper eject portion 1*b*.

Figure 3:
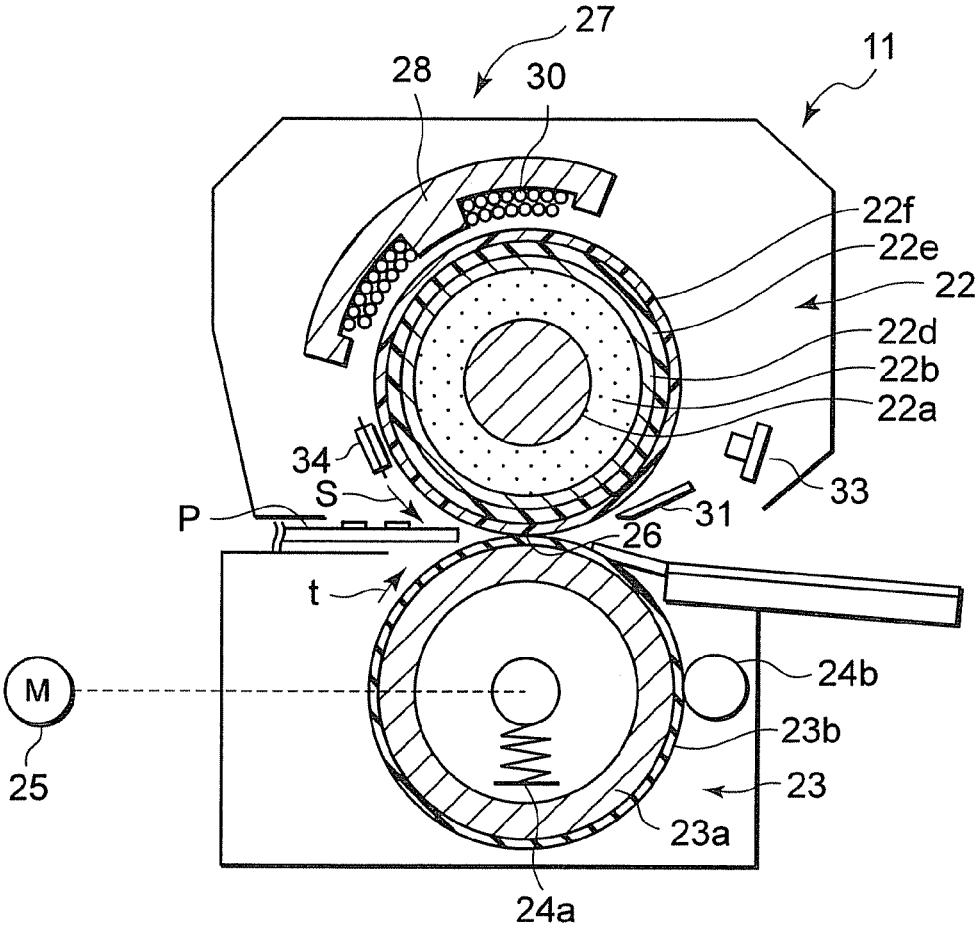
FIG. 3 is a schematic structural view in which the fixing device of the first embodiment of the invention is seen in an axial direction.
Figure 4:
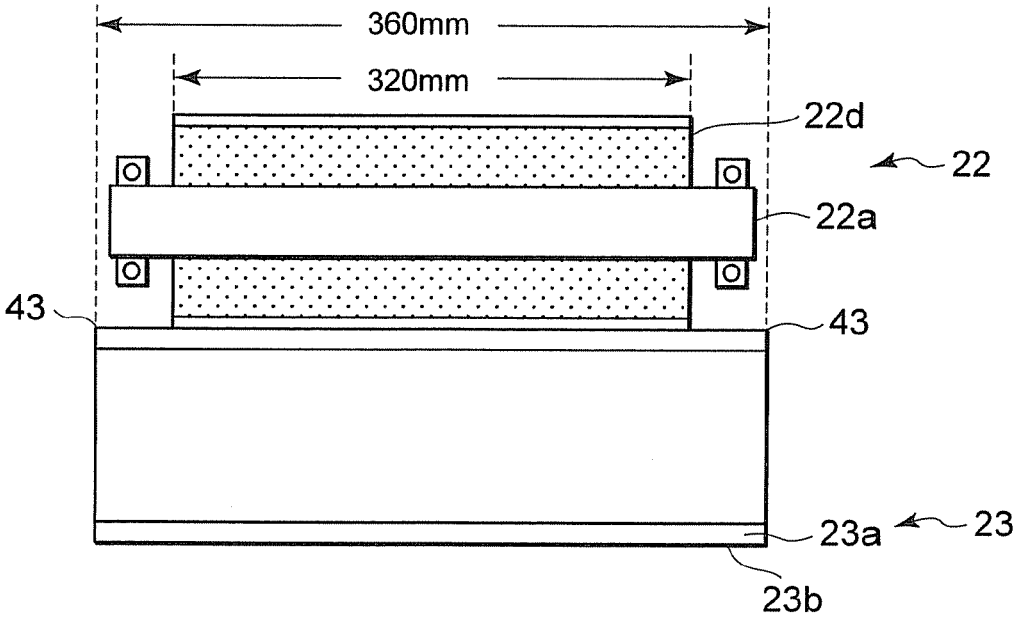
FIG. 4 is a schematic explanatory view in which the fixing device of the first embodiment of the invention is seen in a direction parallel to an axis.

Next, the fixing device 11 will be described. As shown in FIG. 3 and FIG. 4, the fixing device 11 includes a heat roller 22 which is a heating target member, and a press roller 23 which is a pressure member. The heat roller 22 is formed to have a first length of 320 mm in an axial direction. The press roller 23 is formed to have a second length of 360 mm in the axial direction, which is longer than the first length. As shown in FIG. 3, the length of the heat roller 22 in the axial direction falls within the range of the length of the press roller 23 in the axial direction.

The press roller 23 is driven by a stepping motor 25, which is a drive mechanism, in an arrow t direction. The press roller 23 is brought into press contact with the heat roller 22 by a compression spring 24*a*. By this, a nip 26 with a definite width is formed between the heat roller 22 and the press roller 23. The heat roller 22 is driven by the press roller 23 and is rotated in an arrow direction.

Further, an induction current generation coil 27, which is an induction current generation member, to heat the heat roller 22 is disposed in the vicinity of the outer periphery of the heat roller 22 so as to be opposite thereto through a gap. The induction current generation coil 27 uses, for example, a litz wire 30 which is made of 19 twisted copper wires each having a wire diameter of 0.5 mm and has a wire diameter of about 3 mm. As an insulating material of the copper wire, heat-resistant polyamide-imide is used. The wire and the insulating material are not limited to these, and the wire diameter is also arbitrary. In the case where the litz wire is used, its structure is also arbitrary, and plural copper wires may be simply bundled, and the number of copper wires and the thickness are also not limited.

The induction current generation coil 27 is formed such that the litz wire 30 is wound around a magnetic core 28 into a coil shape. When a high frequency current is applied to the litz wire 30, the induction current generation coil 27 generates a magnetic flux. By this magnetic flux, an eddy-current is generated in the heat roller 22 so as to prevent the change of the magnetic field. The Joule heat is generated in a metal conductive layer 22*d* by this eddy-current and the resistance of the heat roller 22, and the heat roller 22 is heated. The magnetic core 28 can more concentrate the magnetic flux generated by the induction current generation coil 27 on the heat roller 22.

Further, a non-contact peel pawl 31 to prevent the sheet paper P after fixing from winding, a thermistor 33 to detect the surface temperature of the heat roller 22, and a thermostat 34 to detect the abnormality of the surface temperature of the heat roller 22 and to cut off the heating are provided at the periphery of the heat roller 22. Incidentally, when there is no fear that the sheet paper P winds around the heat roller, the peel pawl 31 may not be provided. A cleaning roller 24*b* is provided at the periphery of the press roller 23.

Each of the heat roller 22 and the press roller 23 is formed to have a diameter of, for example, 40 mm. The heat roller 22 includes, around a cored bar 22*a*, a heat-resistant foamed rubber (sponge) (for example, silicone rubber) 22*b* which is an elastic member and has a thickness of 5 mm, the metal conductive layer 22*d* made of nickel (Ni) and having a thickness of 40 μm, a solid rubber layer 22*e* having a thickness of 200 μm, and a release layer 22*f* having a thickness of 30 μm. By the structure as stated above, the surface hardness of the heat roller 22 is ASCA rubber hardness of 20 to 25. The metal conductive layer 2*c* is not limited to nickel, but may be stainless, aluminum, or compound material of stainless and aluminum.

Figure 5:
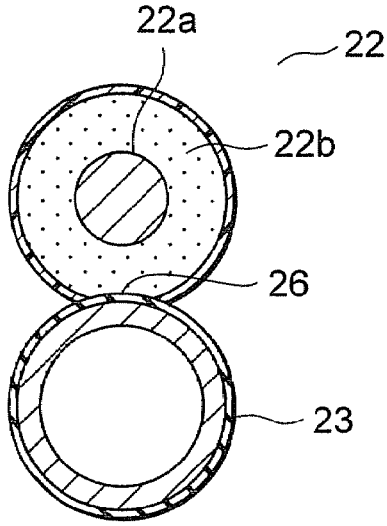
FIG. 5 is a schematic explanatory view showing a sectional shape of a nip between a heat roller and a press roller of the fixing device of the first embodiment of the invention.

The press roller 23 includes a cored bar 23*a*, and a rubber layer 23*b* of silicone rubber or fluorine rubber covering the periphery of the cored bar. By the structure as stated above, the surface hardness of the press roller 23 is higher than the surface hardness of the heat roller 22. Accordingly, as shown in FIG. 5, the section of the nip 26 between the heat roller 22 and the press roller 23 forms a curve in a direction in which the sheet paper P is curled to the press roller 23 side (direction of separating from the heat roller 22).

At the time of drive start of the press roller 23 toward the arrow t direction, the increase rate of an input pulse of power applied to the stepping motor 25 is controlled to decrease the acceleration of rising until the press roller 23 reaches a peripheral speed. In the related art, with respect to a press roller, a time from the stop state to the peripheral speed at the time of fixing is 0.1 second to 0.5 second. On the other hand, in this embodiment, the acceleration of rising is controlled to be decreased so that for example, a time from the stop state of the press roller 23 to the peripheral speed at the time of fixing is 0.5 second to 3 seconds. Although the speed of rising of the press roller is not limited to this, it is desirable to be within the time of a warm-up time in which the heat roller 22 reaches a fixable temperature.

The foamed rubber (sponge) 22*b* of the heat roller 22 can not directly transmit the rotation of the metal conductive layer 22*d* to the cored bar 22*a* at the time of rotation start in the arrow s direction or at the time of stop. The driving transmitted from the stepping motor 25 through the press roller 23 to the metal conductive layer 22*d* is transmitted to the cored bar 22*a* in a state where some distortion occurs in the foamed rubber (sponge) 22*b*. The distortion of the foamed rubber (sponge) 22*b* becomes large as the acceleration rate or the deceleration rate of the metal conductive layer 22*d* becomes large, and the stress applied to the foamed rubber (sponge) 22*b* becomes large.

When the stress applied to the foamed rubber (sponge) 22*b* is large, while the heat roller 22 is used for a long term, peeling due to fatigue occurs in a contact portion between the cored bar 22*a* and the foamed rubber (sponge) 22*b*. Thus, the increase rate of the input pulse of the power applied to the stepping motor 25 at the time of start of the heat roller is controlled, so that the acceleration of rising from the stop state of the press roller 23 to the peripheral speed at the time of fixing is decreased, and the stress applied to the foamed rubber (sponge) 22*b* is decreased. As a result, it is prevented that the foamed rubber (sponge) 22*b* is peeled off from the cored bar 22*a* by the fatigue.

Here, at the time of stop of the heat roller 22, since the foamed rubber (sponge) 22*b* first receives the stress in the direction in which the distortion is returned, the stress applied to the foamed rubber (sponge) 22*b* at the time of stop of the heat roller 22 is small as compared with the stress applied to the foamed rubber (sponge) 22*b* at the time of start. Accordingly, in this embodiment, the stepping motor 25 is driven and controlled so that the acceleration rate of the heat roller 22 at the time of start is set to be lower than the deceleration rate at the time of stop.

Besides, in this embodiment, the press roller 23 is driven by the stepping motor 25, and the heat roller 22 is driven by the press roller 23. By doing so, the driving force of the stepping motor 25 is almost directly transmitted to the press roller 23 and the surface of the heat roller 22. On the other hand, in the case where the heat roller 22 is driven by the drive mechanism, the driving of the drive mechanism is transmitted through the foamed rubber (sponge) 22*b* to the heat roller 22 and the press roller 23. However, when the setting is performed in view of the elasticity of the foamed rubber (sponge) 22*b*, the heat roller may be driven by the drive mechanism, and the press roller 23 may be driven by the heat roller 22.

The sheet paper P passes through the nip 26 between the heat roller 22 and the press roller 23, so that a toner image on the sheet paper P is heated, pressed and fixed. Besides, the sheet paper P is bent in the direction of separating from the heat roller 22 by the curve of the nip 26, and is ejected from the nip 26. By this, the leading end of the sheet paper P is separated from the heat roller 22 without using a peel pawl.

Next, the operation will be described. In the image forming unit 10, when the image forming process starts, in the image forming stations 18Y, 18M, 18C and 18K of the respective colors of yellow (Y), magenta (M), cyan (C) and black (K), toner images are respectively formed on the photoconductive drums 12Y, 12M, 12C and 12K. The toner images on the photoconductive drums 12Y, 12M, 12C and 12K are transferred to the sheet paper P on the transfer belt 10*a* rotated in the arrow q direction by the transfer rollers 15Y, 15M, 15C and 15K, and a full-color toner image is formed on the sheet paper P. Thereafter, the sheet paper P passes through the nip 26 between the heat roller 22 and the press roller 23 of the fixing device 11, the toner image is heated, pressed and fixed, and the print image is completed.

In the fixing device 11, when the image formation process starts, the press roller 23 is driven by the stepping motor 25 in the arrow t direction, and the heat roller 22 driven by this is rotated in the arrow s direction. At this time, the increase rate of the input pulse of power applied to the stepping motor 25 at the time of start of the heat roller is controlled, so that the acceleration of rising from the stop state of the press roller 23 to the peripheral speed at the time of fixing is decreased. That is, the acceleration rate of the heat roller 22 is low, the stress applied to the foamed rubber (sponge) 22*b* can be made small. Besides, in the fixing device 11, in accordance with the detection result of the surface temperature of the heat roller 22 by the thermistor 33, electric power is supplied to the induction current generation coil 27 and the heat roller 22 is heated. By this, the induction current generation coil 27 is heated at high speed to the fixing temperature of, for example, 160° C., and fixing becomes possible.

In this way, in the fixing device 11, the sheet paper P is nipped and carried to between the heat roller 22 and the press roller 23 rotating in the arrow s direction and the arrow t direction, and the toner image is heated, pressed and fixed. However, since the heat roller 22 uses the foamed rubber (sponge) 22*b* having elasticity, a difference between right and left diameters or a tolerance in assembly occurs. Accordingly, while the toner image is heated, pressed and fixed to the sheet paper P, right and left loads in the heat roller 22 become uneven, and the running becomes unstable at the right and left in the axial direction. As a result, there is a case where the heat roller 22 laterally shifts during the fixing operation.

However, the length of the heat roller 22 in the axial direction falls within the range of the length of the press roller 23 in the axial direction while leaving a margin of almost 30 to 50 mm at the right and left. That is, even if the heat roller 22 laterally shifts to some degree, there is no fear that an edge 43 of the press roller 23 comes in contact with the surface of the heat roller 23. Accordingly, even if the heat roller 22 laterally shifts to some degree, there is no fear that it comes in contact with the edge 43 of the press roller 23. From this, even in the case where fixing is performed for a long term, there is no fear that a crack occurs in the metal conductive layer 22*d*.

While fixing is performed, at the nip 26 between the heat roller 22 and the press roller 23, the sheet paper P is curled in the direction of separating from the heat roller 22 by the sectional shape of the nip 26. Accordingly, after fixing, the leading end of the sheet paper P having passed through the nip 26 is separated from the heat roller 22 by the curl even if the peel pawl is not used. Thereafter, the sheet paper P having passed through the nip 26 is prevented from being wound in the direction of the heat roller 22 by the peel pawl 31, and is certainly supplied in the direction toward the paper eject roller 40. Next, the sheet paper P passes through the paper eject conveyance path 41 and is ejected to the paper eject portion 1*b*, and the image formation is completed.

After fixing is finished, the reduction rate of the input pulse of power applied to the stepping motor 25 is controlled so that the time required for the press roller 23 to stop becomes long as compared with the prior art. However, as compared with the time of rising of the press roller 23, the stress applied to the foamed rubber (sponge) 22*b* of the heat roller 22 at the time of stop is small, and therefore, as compared with the deceleration rate of the acceleration at the time of rising, the deceleration rate at the time of stop is set to be small.

According to this embodiment, the metal conductive layer 22*d* of the heat roller 22 is supported by the foamed rubber (sponge) 22*b*, and the surface hardness of the heat roller 22 is made lower than the surface hardness of the press roller 23. By this, the sheet paper P can be separated from the heat roller 22 without using a contact type peel pawl. As a result, it is possible to certainly prevent the damage of the metal conductive layer 22*d* near the surface of the heat roller 22, which was caused by the contact with the peel pawl in the prior art. Besides, according to this embodiment, the press roller 23 is formed to be longer than the heat roller 22 in the axial direction. By this, even if the heat roller 22 using the elastic foamed rubber (sponge) 22*b* laterally shifts during the rotation running, there is no fear that the edge 43 of the press roller 23 comes in contact with the heat roller 22. From this, even in the case where fixing is performed for a long term, a crack due to the interference with the edge 43 of the press roller 23 does not occur in the metal conductive layer 22*d*, and the prolongation of the life of the heat roller 22 is obtained.

Besides, according to this embodiment, at the time of start of the stepping motor 25, the increase rate of the input pulse is controlled so that the acceleration of rising of the press roller 23 is decreased. By this, at the time of start of the heat roller 22, the stress applied to the foamed rubber (sponge) 22*b* can be reduced. As a result, it is possible to prevent that the foamed rubber (sponge) 22*b* is peeled off from the cored bar 22*a* by the fatigue due to the long-term use of the heat roller 22, and the prolongation of the life of the heat roller 22 is obtained. Further, at the time of stop of the stepping motor 25, the deceleration rate of the input pulse is controlled so that the time required for the press roller 23 to stop becomes long, and therefore, at the time of stop of the heat roller 22, the stress applied to the foamed rubber (sponge) 22*b* can be reduced.

Next, a second embodiment of the invention will be described. This second embodiment is similar to the foregoing first embodiment except the structure of the fixing device in the first embodiment. Accordingly, in this second embodiment, the same structure as the structure described in the first embodiment is denoted by the same reference numeral and its detailed description will be omitted.

Figure 6:
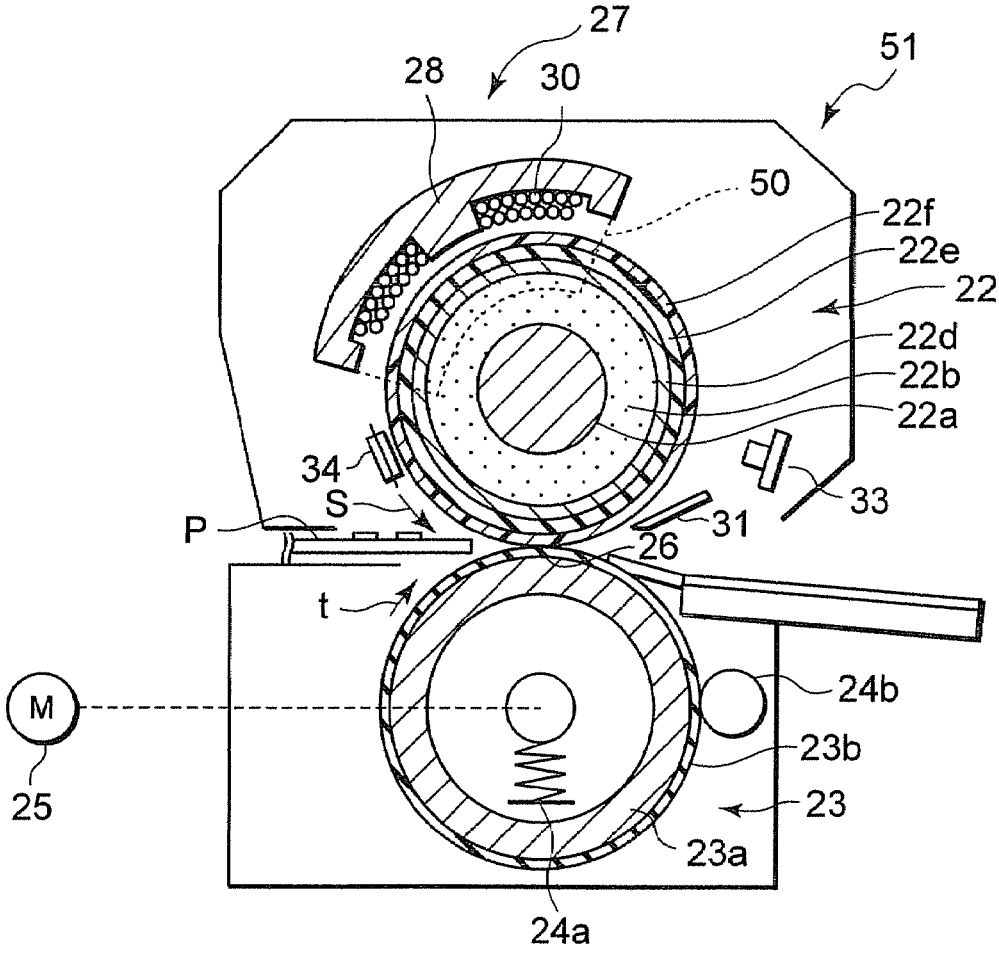
FIG. 6 is a schematic structural view in which a fixing device of a second embodiment of the invention is seen in an axial direction.
Figure 7:
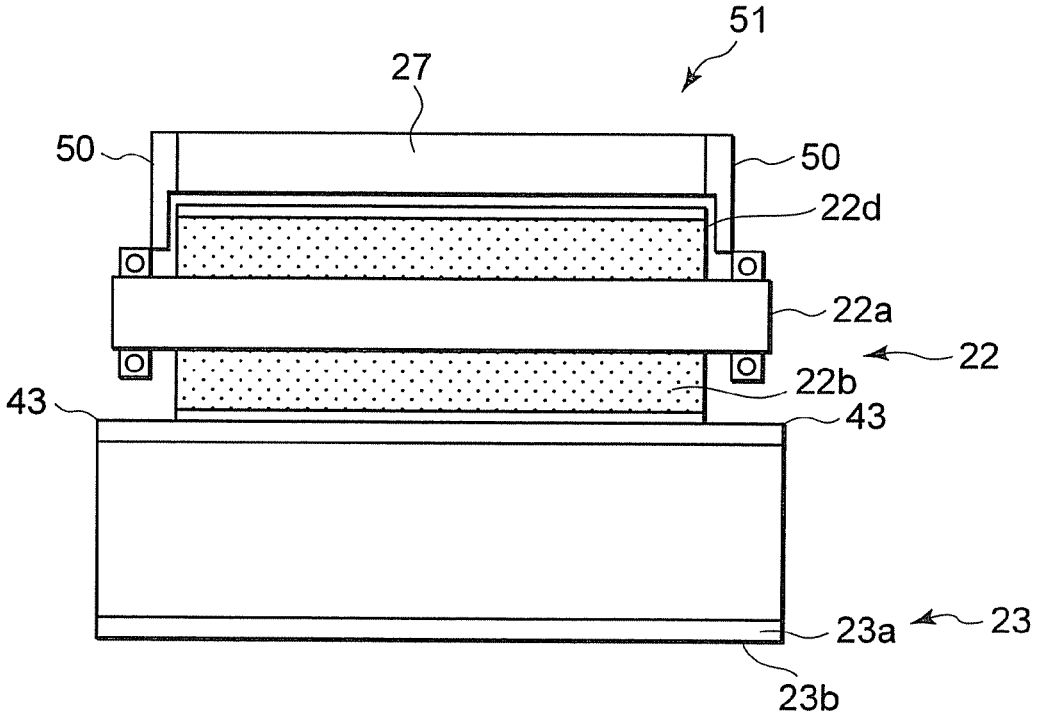
FIG. 7 is a schematic explanatory view in which the fixing device of the second embodiment of the invention is seen in a direction parallel to an axis.

In the second embodiment, as shown in FIG. 6 and FIG. 7, side guides 50 as regulating members are attached to both sides of an induction heating coil 27 of a fixing device 51. Since a heat roller 22 uses a foamed rubber (sponge) 22*b* having elasticity, a difference between right and left diameters or a tolerance in assembly occurs. Thus, there is a fear that the heat roller 22 laterally shifts at the time of rotation running. The side guides 50 regulate both sides of the heat roller 22 so that the heat roller 22 does not laterally shift during the rotation running. The side guides 50 are formed of aluminum (Al) so as not to damage the side surface of the heat roller 22. However, as long as the side surface of the heat roller 22 is not damaged, another metal or a heat-resistant sliding material of fluorine resin or the like may be used for the side guides.

At the time of fixing, the heat roller 22 heated to the fixing temperature by the induction current generation coil 27, together with a press roller 23, nips and carries a sheet paper P, and fixes a toner image on the sheet paper P. During this, the running of the heat roller 22 becomes unstable at the right and left in the axial direction. However, both the sides of the heat roller 22 are regulated by the side guides 50, and it is prevented that the lateral shift occurs at the time of running.

When the heat roller 22 laterally shifts in the prior art, a thrust load occurs on a metal conductive layer 22*d*, and acts on an elastic member inside the metal conductive layer 22*d*. In the case where the elastic member is the foamed rubber (sponge) 22*b* or the like as in the embodiment, the thrust load causes foam breaking, and there is a fear that the elasticity of the foamed rubber (sponge) 22*b* is lost. Accordingly, the lateral shift of the heat roller 22 is prevented by the side guides 50, so that the foam breaking of the foamed rubber (sponge) 22*b* is prevented.

According to this embodiment, similarly to the first embodiment, the surface hardness of the heat roller 22 is made lower than the surface hardness of the press roller 23, so that the sheet paper P can be separated from the heat roller 22 without using a contact type peel pawl. As a result, the damage of the metal conductive layer 22*d* due to the contact of a peel pawl, which occurred in the prior art, can be certainly prevented. Besides, according to this embodiment, the lateral shift of the heat roller 22 is prevented by the side guides 50, and the foam breaking of the foamed rubber (sponge) 22*b* by the thrust load caused by the lateral shift of the heat roller 22 is prevented. As a result, the life of the foamed rubber (sponge) 22*b*, that is the life of the heat roller 22 can be prolonged.

Besides, according to this embodiment, similarly to the first embodiment, the press roller 23 is formed to be longer than the heat roller 22 in the axial direction. Accordingly, irrespective of the regulating member 55, even if the heat roller 22 laterally shifts to some degree, there is no fear that an edge 43 of the press roller 23 comes in contact with the heat roller 22. By this, a crack due to the interference with the edge 43 of the press roller 23 does not occur in the metal conductive layer 22*d* of the heat roller 22, and the prolongation of the life of the heat roller 22 can be obtained.

Incidentally, the attachment positions of the side guides 50 are not limited to both the sides of the induction heating coil 27. For example, the side guides 50 may be attached to side frames or the like inside the main body of the image forming apparatus 1, and both sides of the heat roller 22 may be regulated. Besides, the heating target member is not limited to the heat roller 22, and may be a heat belt which has a metal conductive layer supported by an elastic member and is stretched over plural support rollers. In the heat belt having elasticity, it is hard to equally set the right and left tensile forces relative to the support roller, and the heat belt is liable to laterally shift with respect to the support roller. The side guides 50 regulate the lateral shift of the heat belt with respect to the support roller. By this, the foam breaking of the elastic member of sponge or the like due to the lateral shift is prevented, and the prolongation of the life can be obtained.

Next, a third embodiment of the invention will be described. This third embodiment is similar to the second embodiment except the structure of the regulating member in the second embodiment. Accordingly, in the third embodiment, the same structure as the structure described in the second embodiment is denoted by the same reference numeral and its detailed description will be omitted.

Figure 8:
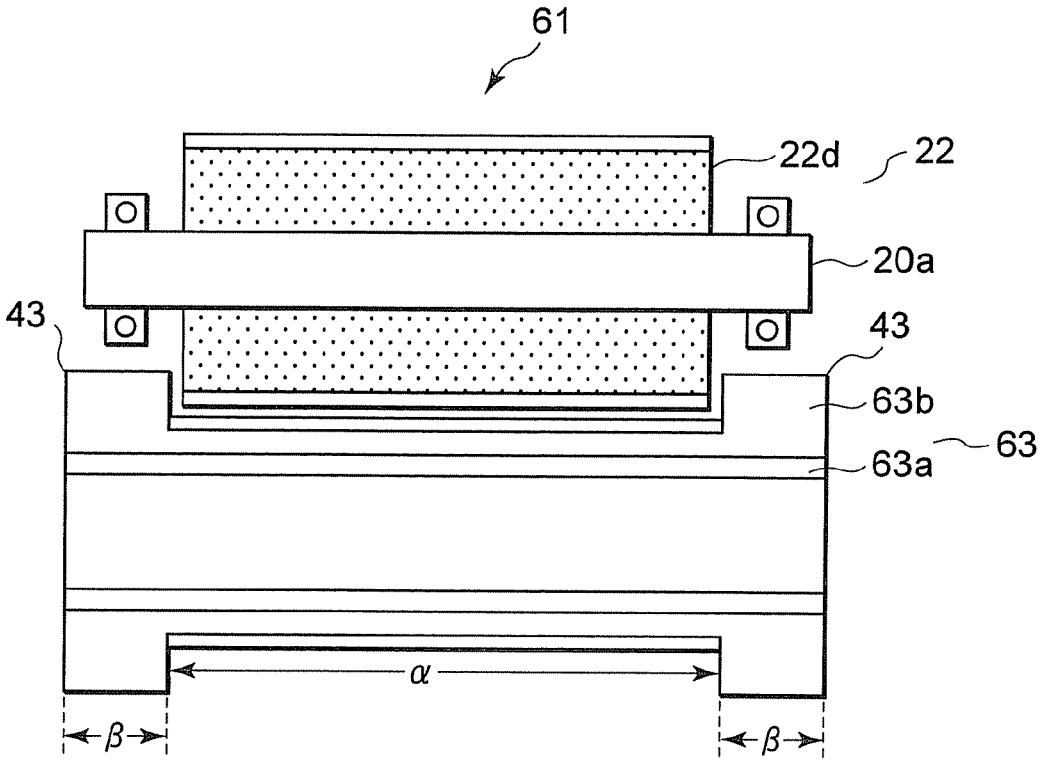
FIG. 8 is a schematic explanatory view in which a fixing device of a third embodiment of the invention is seen in a direction parallel to an axis.

In the third embodiment, as shown in FIG. 8, an opposite area α of a press roller 63 of a fixing device 61 opposite to a heat roller 22 is formed to have a diameter of 40 mm, and extension areas β as regulating members extending to the right and left of the opposite area α are formed to have a diameter of 42 mm. That is, the thickness of a rubber layer 63*b* around a cored bar 63*a* of the press roller 63 is made such that the extension area β is thicker than the opposite area α by 1.0 mm, and a stepped portion is provided.

The heat roller 22 is assembled so as to come in contact with the opposite area α of the press roller 63. Both sides of the heat roller 22 are regulated by the stepped portion between the opposite area α and the extension area β, so that the heat roller 22 does not laterally shift during the rotation running. By this, at the time of fixing, although the heat roller 22 has elasticity, the lateral shift is prevented, and the foam breaking of the foamed rubber (sponge) 22*b* is prevented.

The height of the stepped portion between the opposite area α and the extension area β of the press roller 63 is not limited, and when the height of the stepped portion is 0.5 mm or more, the lateral shift of the heat roller 22 can be certainly prevented.

According to this embodiment, similarly to the second embodiment, a sheet paper P can be separated from the heat roller 22 without using a contact type peel pawl, and damage of a metal conductive layer 22*d* due to contact of the peel pawl can be certainly prevented. Besides, according to this embodiment, the lateral shift of the heat roller 22 is prevented by the stepped portion between the opposite area α and the extension area β of the press roller 63, so that the foam breaking of the foamed rubber (sponge) 22*b* due to the lateral shift of the heat roller 22 is prevented. Besides, there does not occur such a state that an edge 43 of the press roller 63 comes in contact with the heat roller 22, and a crack occurs in the metal conductive layer 22*d* of the heat roller 22. As a result, not only the life of the foamed rubber (sponge) 22*b*, but also the life of the heat roller 22 can be prolonged.

Incidentally, the invention is not limited to the above embodiments, but can be variously changed within the scope of the invention. For example, the structure of the heating target member or the pressure member is not limited, and as the need arises, the pressure member may also include a metal conductive layer heated by the induction current generation coil or may have a built-in halogen lamp heater. Besides, the material and thickness of the elastic member are also not limited, the hardness of each of the heating target member and the pressure member is also arbitrary, and the thickness of the metal conductive layer is also not limited. However, as the metal conductive layer becomes thick, the surface of the heating target member becomes hard irrespective of the hardness of the inside elastic layer, and the width of the nip between itself and the pressure member can not be sufficiently secured.

Accordingly, in order to more quickly heat the heating target member, it is desirable that the thickness of the metal conductive layer is 60 μm or less. Besides, the drive mechanism is not limited to the stepping motor, and the time required to reach the peripheral speed at the time when the heating target member is started, or the time required for stop at the time when the heating target member is stopped is also arbitrary within the range in which the stress applied to the elastic member of the heating target member can be reduced and the life of the heating target member can be prolonged.

Further, the endless heating target member may be a heat belt which includes a metal conductive layer supported by an elastic member and is stretched over plural support rollers. In the heat belt having elasticity, it is hard to equally set the right and left tensile forces, and lateral shift is liable to occur with respect to the support rollers. Accordingly, the pressure member is made longer than the heat belt, so that even in the case where the lateral shift occurs, damage of the metal conductive layer due to the interference with the edge of the pressure member can be prevented. Besides, the lateral shift of the heat belt relative to the support rollers is regulated by the regulating member, so that the foam breaking of the elastic member, such as a sponge, due to the lateral shift can be prevented. By these, the prolongation of the life of the heat belt can be obtained.

What is claimed is:

1. A heat fixing device comprising:

a heating target member that is endless, has a metal conductive layer supported by an elastic member and has a first length in an axial direction;

a pressure member that has a second length extending to outsides of both sides of the heating target member in the axial direction and having a hardness larger than a hardness of the heating target member, comes in press contact with the heating target member at a side opposite to the elastic member, and, together with the heating target member, nips and carries a fixing target medium in a specified direction;

an induction current generation member that is disposed at a periphery of the heating target member and heats the metal conductive layer; and a regulating member to regulate both sides of the heating target member in an axial direction and to prevent the heating target member from moving in the axial direction, and the regulating member is a regulating wall provided at both sides of the induction current generation member in a longitudinal direction.

2. The induction heat fixing device according to claim 1, wherein the heating target member is a heat roller including the elastic member and the metal conductive layer laminated around a cored bar.

3. The induction heat fixing device according to claim 1, wherein the metal conductive layer has a thickness of 60 .mu.m or less.

4. The induction heat fixing device according to claim 1, wherein an acceleration rate of a drive mechanism for the heating target member from a stop state to a fixable speed is lower than a deceleration rate from the fixable speed to the stop state.

5. A heat fixing device comprising:

a heating target member that is endless, has a metal conductive layer supported by an elastic member and has a first length in an axial direction;

a pressure member that comes in press contact with the heating target member at a side opposite to the elastic member and, together with the heating target member, nips and carries a fixing target medium in a specified direction, the pressure member having a hardness larger than a hardness of the heating target member, the pressure member is a press roller;

an induction current generation member that is disposed at a periphery of the heating target member and heats the metal conductive layer; and a regulating member to regulate both sides of the heating target member in the axial direction and to prevent the heating target member from moving in the axial direction, the regulating member is a stepped portion formed in the press roller in which the heating target member is fitted.

6. The induction heat fixing device according to claim 5, wherein the heating target member is a heat roller including the elastic member and the metal conductive layer laminated around a cored bar.

7. The induction heat fixing device according to claim 5, wherein the metal conductive layer has a thickness of 60 μm or less.

8. The induction heat fixing device according to claim 5, wherein an acceleration rate of a drive mechanism for the heating target member from a stop state to a fixable speed is lower than a deceleration rate from the fixable speed to the stop state.

* * * * *